US008454330B2

(12) United States Patent
Lyngholm

(10) Patent No.: US 8,454,330 B2
(45) Date of Patent: Jun. 4, 2013

(54) SUBMERSIBLE PUMP

(75) Inventor: Jan Lyngholm, Sabro (DK)

(73) Assignee: Grundfos Management a/s, Bjerringbro (DK)

( * ) Notice: Subject to any disclaimer, the term of this patent is extended or adjusted under 35 U.S.C. 154(b) by 445 days.

(21) Appl. No.: 12/339,201

(22) Filed: Dec. 19, 2008

(65) Prior Publication Data

US 2009/0162223 A1 Jun. 25, 2009

(30) Foreign Application Priority Data

Dec. 21, 2007 (EP) ..... 07024940

(51) Int. Cl.
*F04B 35/04* (2006.01)

(52) U.S. Cl.
USPC ..... 417/423.3; 417/236; 417/423.5

(58) Field of Classification Search
USPC ..... 417/236, 237, 423.3, 423.5, 32, 42, 417/43, 44.2
See application file for complete search history.

(56) References Cited

U.S. PATENT DOCUMENTS

| | | | | |
|---|---|---|---|---|
| 2,550,667 | A | 5/1951 | Blom | |
| 2,969,740 | A | 1/1961 | Kaatz | |
| 3,021,788 | A | 2/1962 | Kaatz | |
| 3,867,655 | A * | 2/1975 | Stengel et al. | 310/66 |
| 6,612,188 | B2 * | 9/2003 | Hamilton | 73/861.78 |
| 6,811,382 | B2 * | 11/2004 | Buchanan et al. | 417/244 |
| 2003/0127223 | A1 * | 7/2003 | Branstetter et al. | 166/250.15 |
| 2006/0213660 | A1 * | 9/2006 | DiFoggio et al. | 166/254.2 |
| 2006/0260797 | A1 * | 11/2006 | Hall et al. | 166/65.1 |

FOREIGN PATENT DOCUMENTS

| | | | |
|---|---|---|---|
| EP | 1 324 011 | A2 | 7/2003 |
| WO | 2006/053944 | A1 | 5/2006 |

* cited by examiner

*Primary Examiner* — Devon Kramer
*Assistant Examiner* — Thomas Fink
(74) *Attorney, Agent, or Firm* — Panitch Schwarze Belisario & Nadel LLP

(57) ABSTRACT

A bore-hole pump has an electrical drive motor (3) and a multi-stage centrifugal pump (4) which is driven thereby. A sensor housing (9) is arranged at the end of the pump, in which one or more sensors are arranged, and which is surrounded by fluid and through which fluid flows (FIG. 1).

9 Claims, 8 Drawing Sheets

SUBMERSIBLE PUMP

BACKGROUND OF THE INVENTION

The invention relates to a submersible pump, in particular to a bore-hole pump. Submersible pumps are nowadays activated by frequency converters, and thus as a rule have motor electronics which render it necessary, or at least useful, to detect important operating variables of the pump, and to take these into account and process them as the case may be, on activation. Counted amongst these variables are, for example, the winding temperature of the motor, the temperature of the medium to be delivered, the delivery pressure, the ambient pressure, etc.

The arrangement of sensor devices to detect operating variables in submersible pumps is expensive with regard to the design, since on the one hand a data connection to the control and regulation electronics of the motor must exist, and on the other hand an electrical supply is necessary. Furthermore, a reliable sealing with respect to the delivery medium must be ensured. In particular with bore-hole pumps, this also represents a spatial problem, which is why the options have been to not install the sensor devices, or to install them and accept an enormous design expense.

BRIEF SUMMARY OF THE INVENTION

Against this background, it is the object of the invention to design a submersible pump of the known type, in particular a bore-hole pump, such that one or more sensors may be arranged inexpensively at suitable locations, and suitably connected with regard to signal and data.

The submersible pump according to the invention, in particular a bore-hole pump, comprises an electrical drive motor and a single-stage or multi-stage centrifugal pump which is driven by this motor. According to the invention, one or more sensors of the pump are arranged in a sensor housing, through which fluid flows and which is surrounded by fluid. The sensor housing is arranged between the motor and the pump, at the end of the pump or within the pump. Thereby, the sensor housing may either be arranged as a separate housing at the end of the pump, or may also form a part of the pump housing, and thus be integrally formed with the pump housing.

The basic concept of the present invention is, where possible, to accommodate all the sensor devices, at least, however, one or more sensors, in a separate sensor housing which is arranged at the end of the pump, within the pump or between the motor and the pump, thus at the other end of the pump. This sensor housing may be designed in a modular manner, so that as the case may be, it may also be retrofitted to existing pumps. Also, pumps of the same series may be provided with or without a sensor housing, and thus may be delivered with and without sensor devices. Since the sensor housing is arranged between the motor and the pump, within the pump or at the end of the pump, the submersible pump by way of this is not changed with regard to is outer contour, but only with regard to its length, which is particularly important for bore-hole pumps. Since the sensor devices on the one hand are typically in connection with the delivery flow of the pump, and on the other hand with the surrounding medium, the sensor housing according to the invention is advantageously designed and arranged such that on the one hand fluid flows through it, and on the other hand it is surrounded by fluid. Thus, for example, temperatures and/or pressures of the surrounding fluid as well as of the delivered fluid may be detected. Since, where possible, the complete sensor technology or at least a large part is arranged within the sensor housing, then it is only this sensor housing, if anything, which needs to be provided with a cable leading to the outside. This is particularly advantageous with bore-hole pumps, and if the sensor housing is arranged at the upper end of the pump, only the main cable runs next to the delivery conduit. With the arrangement between the motor and the pump, there results the advantage that the cabling may be effected via the motor, which in any case requires a leading of the cable to the outside for supply of electricity and, as the case may be, also to the control and regulation electronics.

The sensor housing is advantageously divided into a fluid-leading housing part and a fluid-free housing part, and these are separated from one another by a housing wall which is preferably formed of stainless steel sheet metal. Such a housing wall may be designed comparatively thin but in an absolutely fluid-tight manner, in the manner of a can, so that with the exception of pressure sensors and/or differential pressure sensors, one may measure, for example, temperature, vibration, etc., as the case may be, also through the housing wall. This has the significant advantage that the electronics and sensor devices, which are highly sensitive to humidity, may be arranged in a reliably fluid-free housing part, whereas access to the delivery medium and/or the surrounding medium through the housing wall also exists in a practical manner.

Usefully, not only a part flow, but the complete delivery flow of the pump is led through the fluid-leading housing part, wherein the housing part is designed such that it quasi represents a further pump stage or pipe extension, and thus offers as little flow resistance as possible. The sensor devices and, as the case may be, the electronics, which are located in the sensor housing, require comparatively little space, so that a small peripheral free space as a rule is sufficient in order to accommodate these components.

According to an advantageous further embodiment of the invention, one envisages producing the electrical energy, which is necessary to operate the sensors arranged in the sensor housing and, as the case may be, to provide and process the electrical signals coming from the sensors and to convert the signals into digital data, directly within the sensor housing, in order to be able to completely avoid the need for a lead for the supply of electricity to the sensor housing. For this, according to the invention, an induction arrangement is provided in the sensor housing, with which electrical energy is produced upon operation of the pump.

Usefully, the induction arrangement comprises at least one magnet which is rotatably arranged in the fluid-leading housing part, and at least one induction coil which is arranged in the fluid-free housing part, in a manner such that a current in the coil is induced by the magnet moving past the coil, the current being able to be used for the previously mentioned purposes. Usefully, two or more magnets are arranged, which cooperate with several induction coils, as the case may be, and thus form a type of electrical generator.

In order to form a drive for the magnets, according to a further embodiment of the invention, one envisages rotatably mounting and arranging a pump impeller within the fluid-leading housing part, such that it is set into rotation by the delivery flow of the pump. With such a design, the sensor housing is formed quasi as a further passive pump stage, and the delivery flow which flows through drives the pump impeller arranged therein, with the magnets fastened thereto, which on account of this induce a voltage in the coil or coils, or produce a current and thus supply the sensor devices within the housing with electricity.

According to a further formation of the invention, such a passive pump impeller which is arranged within the sensor housing in a freely rotatable manner, and on which at least one magnet is arranged, may also form part of a flowmeter, wherein an inductive receiver, for example, a coil, is then arranged within the fluid-free housing part, so that the rotational speed of the pump impeller may be detected and the flow quantity may be evaluated via this. A pump impeller does not necessarily have to be arranged in a rotatable manner, and a type of blade may be arranged in a rotatable manner, at whose end a magnet is seated, which rotates quicker or slower depending on the flow quantity.

If, on the other hand, the sensor housing is a more or less integral constituent of the pump, the pump's design may be adapted accordingly, then, advantageously, instead of having a passive impeller, the drive shaft may be extended up into the sensor housing and may be provided there with a holder, which itself carries the magnet or magnets, and which rotates (on its own accord) by way of the drive shaft itself. One may also provide an active pump impeller which carries magnets.

Given an integral design of the sensor housing in the pump housing, in principle, with a multi-stage bore-hole pump, for example, each and any pump stage may be designed as sensor housing by way of a suitable modification. It is thus also conceivable to not only provide one, but several sensor housings, in order, for example, to be able to monitor the pressure of each individual pump stage.

If one can avoid a supply of electricity of the sensor housing, from the outside, for example, by way of the previously mentioned design measures, it is then particularly useful to also lead out the electrical signals and/or sensor data, which lead out of the sensor housing, in a cable-less manner. According to a further embodiment of the invention, one therefore envisages providing suitable transmission means within the sensor housing, in order to inductively couple the electrical signals of the sensors or the data derived therefrom, into an electrical cable led on the outside on the sensor housing. Such a cable, particularly with bore-hole pumps, runs continuously parallel to the pump. It is useful to utilize such a cable, which is required in any case for the electrical supply of the motor, for the data transmission. Thereby, a corresponding signal is transmitted out of the sensor housing onto at least one lead in the cable, and this signal must be of a nature such that it may be separated from the frequency of the electricity supply by way of suitable filters.

Alternatively, one may provide a radio transmission out of the sensor housing, to a receiver in the motor housing, or also to an electronics housing which is typically arranged above the water surface and which comprises the control and regulation electronics for the motor.

Since an electrical supply cable to the motor is present in any case, by way of suitable design, this may also be used in a simple manner for data transmission, be it by way of modulating the signal, or by way of providing a further lead. It is then useful to transmit the electrical signals of the sensors or the data derived therefrom, from the sensor housing into the motor housing. This may be transmitted by radio, but also mechanically by the pump housing, but preferably via the common shaft. For this, an electro-acoustical transducer may be provided in the region of the sensor housing, and this transducer converts the electrical signal into a sound signal, typically an ultrasound signal and transmits it directly or indirectly onto the shaft. An acousto-electrical transducer is then provided on the motor side, which again converts this signal into an electrical signal which is then led out in a suitable manner.

The most varied of sensors may be arranged within the sensor housing, typically one or more temperature sensors for detecting the temperature of the delivery flow and/or of the surrounding medium, a vibration sensor for detecting mechanical oscillations, a pressure sensor or differential pressure sensor for detecting the ambient pressure and/or the delivery pressure. These are only examples and may be supplemented by any further sensors.

Particularly preferably, at least these sensors, which do not necessary have to be in contact with the surrounding or delivered fluid, such as, e.g., the pressure sensor or the differential pressure sensor, are arranged on the fluid-free housing part. Thus, with a suitable design of the housing wall, the temperature sensor may be arranged separately from the fluid by way of the housing wall, similarly to the vibration sensor, which evidently entails advantages.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

In the drawings:

FIG. 3(*b*) is a schematic sectional detail view of a portion of the sensor housing shown in FIG. 3(*a*).

FIG. 7(*b*) is a schematic sectional lateral view of a motor housing portion of an embodiment of a bore-hole pump with a mechanical signal transmission from the sensor housing to the motor housing;

FIG. 8(*b*) is a schematic sectional lateral view of a motor housing portion of a further embodiment of a bore-hole pump with a mechanical signal transmission from the sensor housing to the motor housing;

DETAILED DESCRIPTION OF THE INVENTION

Figure 1:
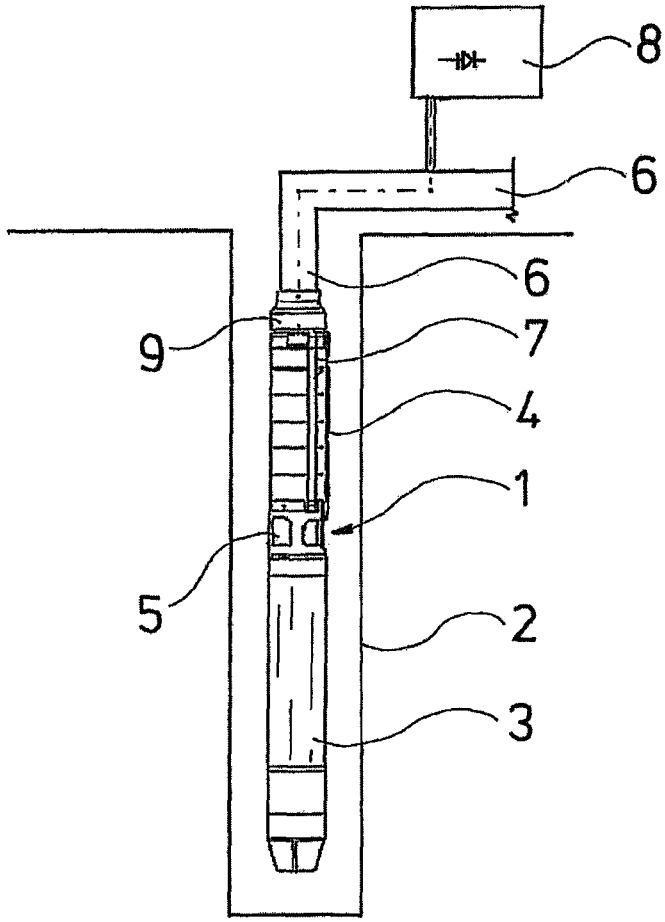
FIG. 1 is a simplified schematic longitudinal view of a bore-hole pump in a bore-hole.

The bore-hole pump 1 represented by way of FIG. 1 is lowered into a bore-hole 2. It consists of a lower motor part 3, of which only the motor housing is visible in FIG. 1, and a multi-stage centrifugal pump 4 connects thereto to the top, whose pump stages are indicated in FIG. 1. Suction openings 5 are located between the motor 3 and the pump 4, via which the fluid located in the bore-hole 2 is sucked, delivered upwards through the multi-stage centrifugal pump 4 and finally conveyed via a pressure conduit 6 to the consumption location.

The motor 3 is supplied via a cable 7, which is led along on the outside in the region of the centrifugal pump 4, and runs next to the pressure conduit 6 to a supply and control housing 8, via which the motor is supplied with electricity. A frequency converter may for example be provided within the control housing 8, as well as all means for the control and monitoring of the pump. A sensor housing 9 whose construction is explained by way of example hereinafter, is arranged between the upper end of the centrifugal pump and the lower end of the pressure conduit 6.

Figure 2:
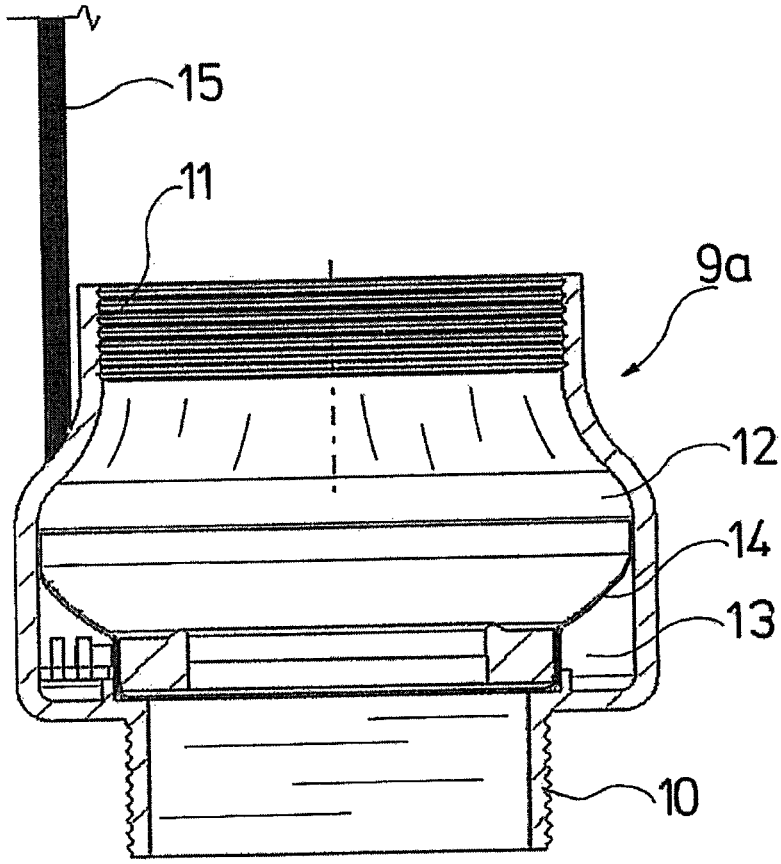
FIG. 2 is a schematic perspective sectional view of a first embodiment of a sensor housing.

The sensor housing 9*a* represented in FIG. 2 is constructed in a rotationally symmetrical manner, is adapted in its outer periphery to the outer periphery of the pump stages, and on its lower side has a threaded union 10, which is provided for incorporation into the end-side thread of the centrifugal pump 4. The housing wall projects radially outwards from the threaded union 10, so that it is aligned with the peripheral housing wall of the pump stages 4 lying therebelow. The housing wall is reduced towards the upper end, and on the inner side is provided with an inner thread 11 which in pitch and diameter corresponds to the inner thread at the upper end of the pump, so that the pressure conduit 6 may be connected selectively directly, to the upper end of the pump, or amid the integration of the sensor housing 9*a*.

The sensor housing 9*a* comprises a fluid-leading, inner housing part 12 and a fluid-free outer housing part 13, which are separated from one another by way of a can-like, thin wall 14. The fluid-leading housing part 12 is designed in an essentially tubular manner and continues the cross section of the pressure conduit 6 in a widening manner, to then again merge into the threaded union 10. The fluid-free housing part 13 is arranged in the widened region and forms a peripheral, annular space, in which sensors, specifically a temperature sensor bearing on the wall 14, for detecting the temperature of the delivery medium, a pressure sensor penetrating the wall 14, for detecting the pressure of the delivery fluid, a pressure sensor penetrating the outer wall, for detecting the ambient pressure, and a vibration sensor are arranged. Moreover, the electronics which are required for processing the electrical signals delivered by the sensors are provided within this fluid-free housing part 13. The electricity supply of the sensor devices located within the sensor housing 9*a* is effected via a cable 15 via which the electrical signals of the sensors are also led out. The cable 15 may be led together with the cable 7 or run parallel thereto.

Figure 3:
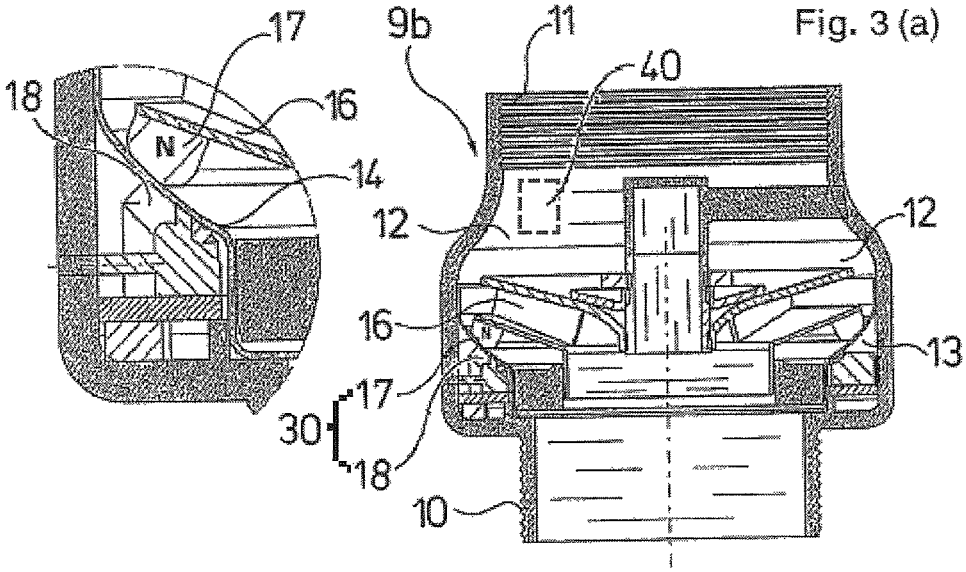
FIG. 3(*a*) is a schematic sectional view of second embodiment of a sensor housing.

The sensor housing 9*b* represented by way of FIGS. 3(*a*) and 3(*b*) has the same outer contour as the sensor housing 9*a*, but, however, in the inner, fluid-leading part 12, includes a passive, i.e. non-driven, pump impeller 16 which is driven, i.e., is set into rotation, by the through-flowing delivery fluid. Magnets 17 which run at a slight distance to the wall 14, are arranged on the lower side of the pump impeller 16. Coils 18 are provided directly adjacently within the fluid-free housing part 13 and bearing on the wall 14, in which a current is produced when the magnets 16 run past, which serves for the electrical power supply of the one or more sensors (shown schematically in FIG.3(*a*) as sensor 40) and electronics located in the sensor housing 9*b*. The sensor signals or the data evaluated therefrom are either fed via a data cable or in an inductive manner, into the cable 7 led there on the housing 9*b*.

Figure 4:
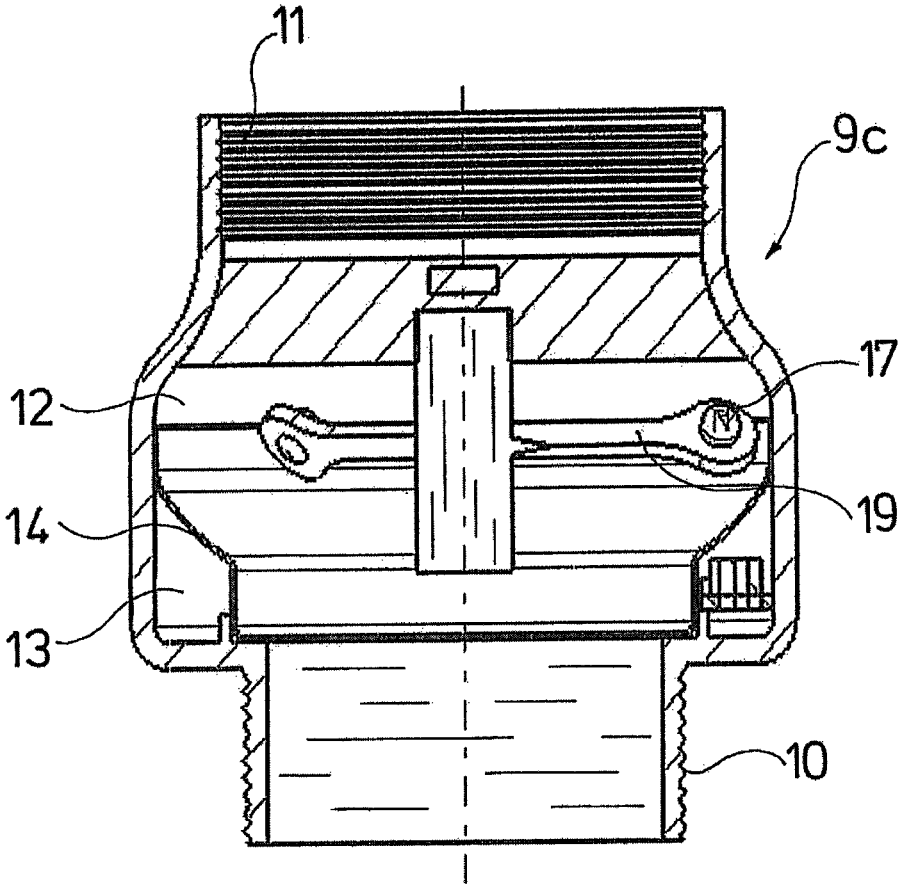
FIG. 4 is a schematic sectional view of a third embodiment of a sensor housing.
Figure 5:
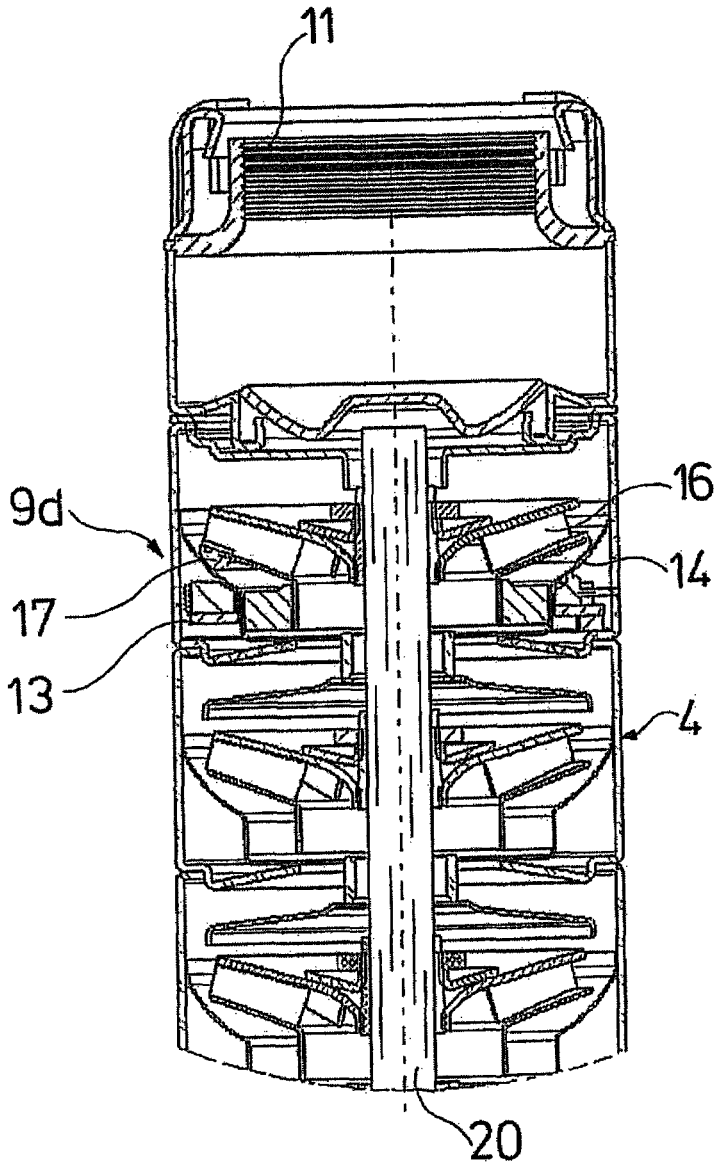
FIG. 5 is a schematic sectional lateral view of an upper portion of a bore-hole pump with an integrated sensor housing.

With the embodiment variant of the sensor housing 9*c* represented by way of FIG. 4, a two-armed blade 19 is provided instead of the pump impeller 16, and this blade carries magnets 17 at its ends, which serve for the electricity supply in the same manner as described beforehand by way of FIG. 3. The blades 19 are set obliquely with their end surfaces, so that given a through-flow, they are likewise set into rotation, but have a significantly lower flow resistance compared to the impeller 16.

Such a passive pump impeller 16, which is arranged within the sensor housing in a freely rotatable manner, and on which at least one magnet 17 is arranged, may also form part of a flowmeter 30, wherein an inductive receiver, for example, coil 18, is then arranged within the fluid-free housing part 13, so that the rotational speed of the pump impeller 16 may be detected and the flow quantity may be evaluated via this. A pump impeller 16 does not necessarily have to be arranged in a rotatable manner, and a type of blade may be arranged in a rotatable manner, at whose end a magnet 17 is seated, which rotates quicker or slower depending on the flow quantity.

Embodiment variants are described by way of FIGS. 5-8, with which the sensor housing is an integral constituent of the pump housing, or is unreleasably connected to the pump housing. With the embodiment according to FIG. 5, the drive shaft for the impellers of the centrifugal pump 4 is extended to the top, and at the upper end carries a pump impeller 16 which is an active impeller on account of the drive by the shaft 20. However, it is integrated within a sensor housing 9*d*, whose wall 14 separates the fluid-free housing part 13 from the remaining pump housing. Magnets 17 are arranged on the pump impeller 16 at the lower side and these cooperate with corresponding coils 18 in the fluid-free housing part 13 in the same manner as described previously by way of FIG. 3, and ensure the supply of electricity within the sensor housing 9*d*. The sensor housing 9*d* may also be formed by way of modifying any pump stage. Thus one may also provide several sensor housings 9*d*, if e.g., several pump stages are to be monitored.

Figure 6:
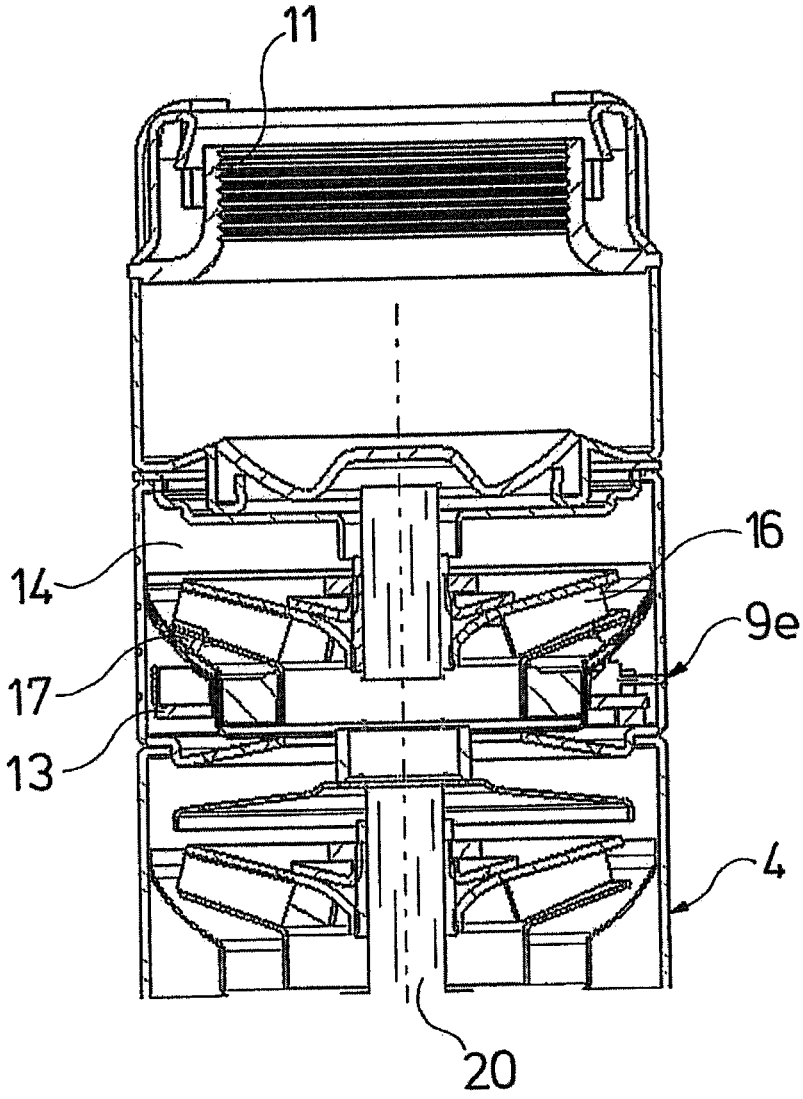
FIG. 6 is a schematic sectional lateral view of an alternative embodiment of a pump with a sensor housing integrated in the pump housing.

With the embodiment variant according to FIG. 6, the sensor housing 9*e* is likewise firmly connected to the last stage of the centrifugal pump 4, but there the pump impeller 16 which is mounted within the sensor housing 9*e* is freely rotatable, thus is designed as a passive pump impeller similarly to the arrangement according to FIG. 3. Here too, the electricity supply of the sensor devices is effected via magnets 17 on the lower side of the pump impeller 16, which cooperate with coils arranged within the fluid-free housing part 13.

Figure 7:
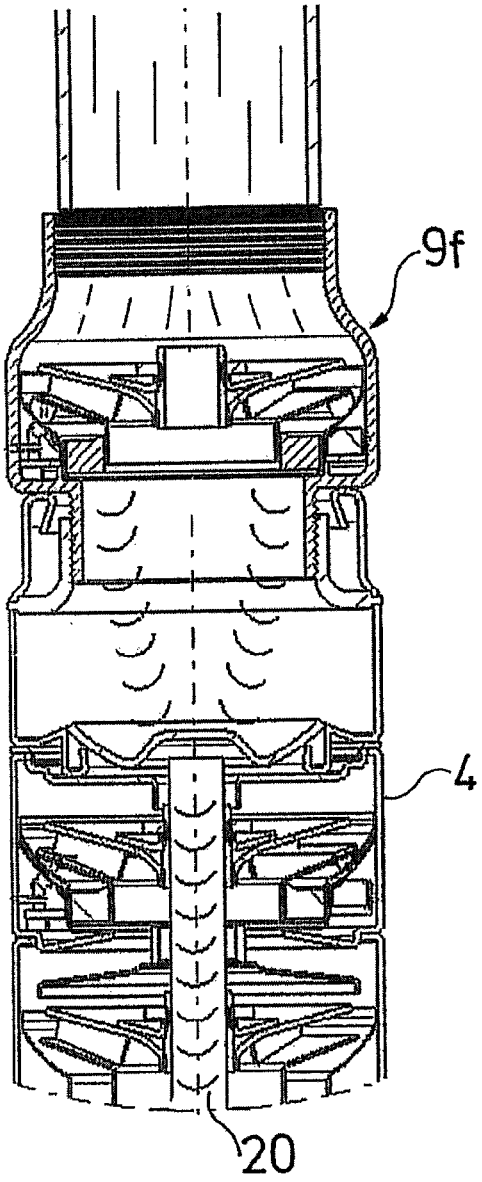
FIG. 7(*a*) is a schematic sectional lateral view of a sensor housing portion of an embodiment of a bore-hold pump with a mechanical signal transmission from the sensor housing to the motor housing.
Figure 7:
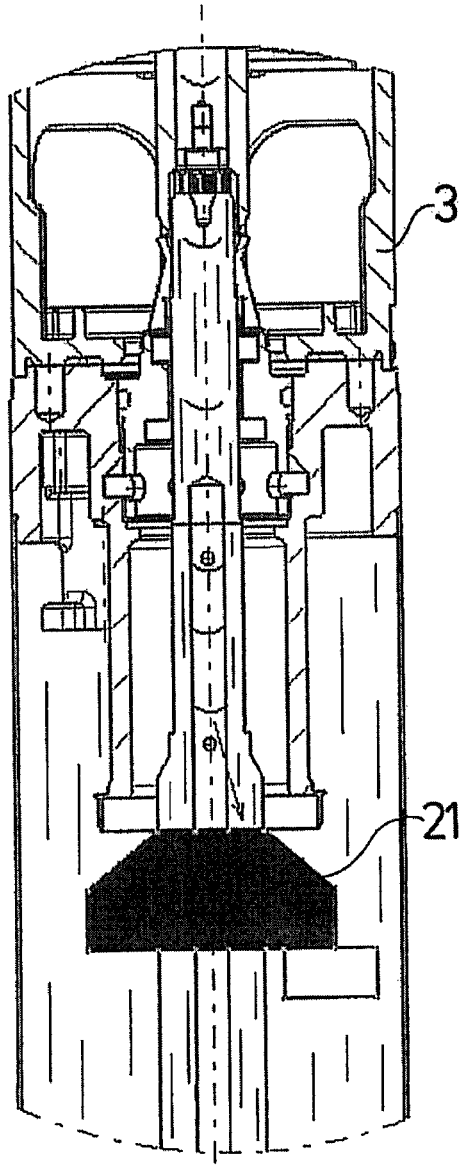

In the representation according to FIGS. 7(*a*) and 7(*b*), the upper end of a multi-stage centrifugal pump 4 is represented as FIG. 7(*a*), whose lower end connects to the motor part 3 which is shown as FIG. 7(*b*). A common shaft 20 leads through the housing part and continues in the motor part 3. The sensor housing 9*f*, which is attached on the upper end of the pump 4, corresponds essentially to that which is represented and explained by way of FIG. 3. However, here, a signal transmission out of the fluid-free housing part 13 is effected through the fluid up to the shaft 20, by way of mechanical waves. For this, an electro-acoustic transducer its provided within the fluid-free housing part 13 of the sensor housing 9*f*, and converts the sensor signals into ultrasound signals which may be transmitted up to the shaft 20 via the fluid. An acousto-electrical transducer 21 is provided on the motor-side end of the shaft 20 and converts these mechanical oscillations again into an electrical signal, which is then led via the supply cable 7 of the motor, to the supply and control housing 8.

Figure 8:
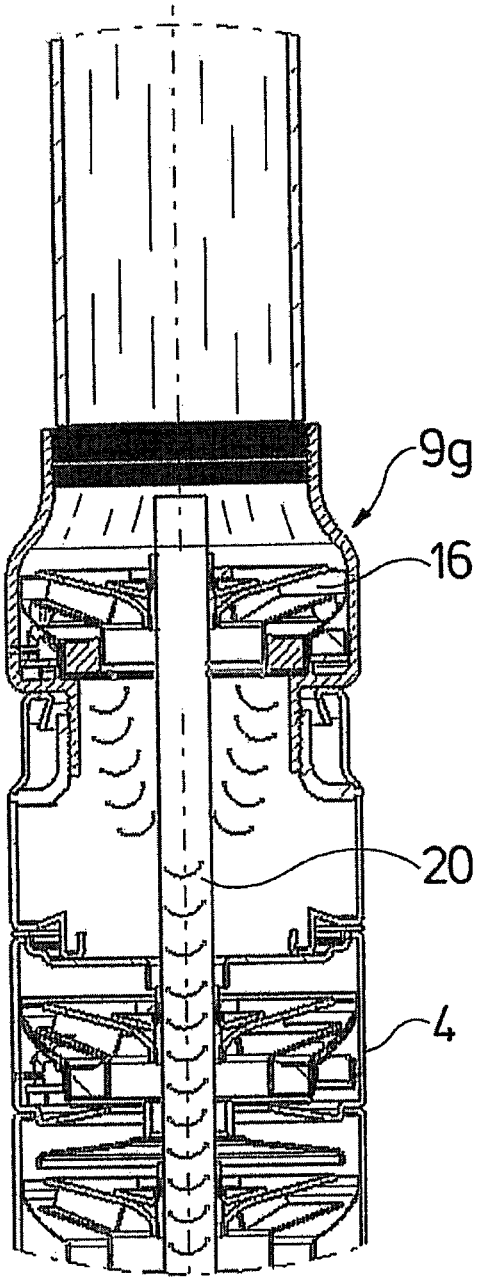
FIG. 8(*a*) is a schematic sectional lateral view of a sensor housing portion of a further embodiment of a bore-hole pump with a mechanical signal transmission from the sensor housing to the motor housing.
Figure 8:
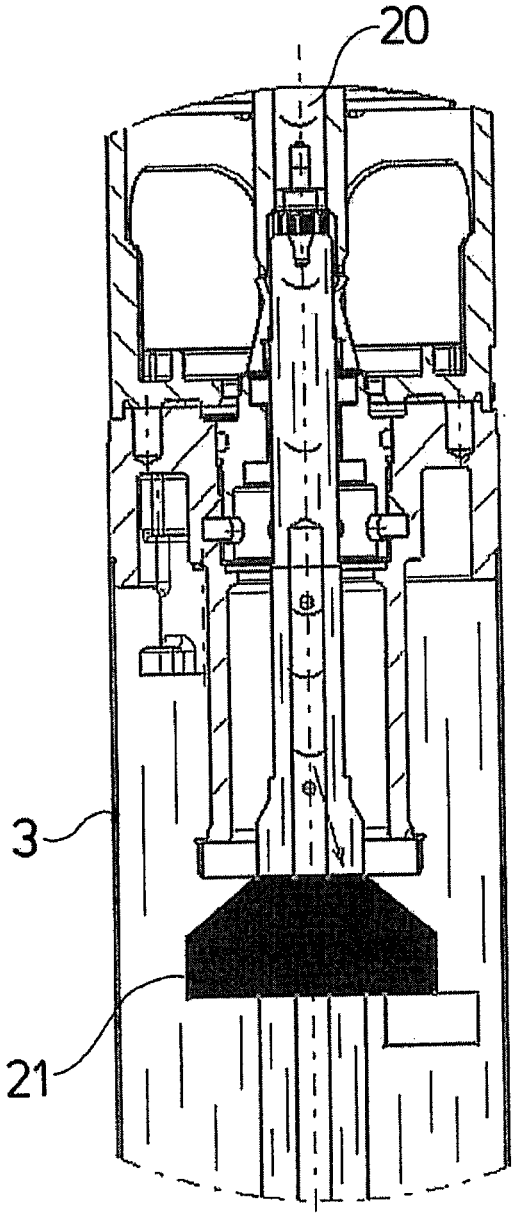

With the embodiment variant represented by way of FIGS. 8(*a*) and 8(*b*), the shaft 20 is led up to into the sensor housing 9*g*, on which a pump impeller 16 of the previously described design according to FIG. 3 is seated. This pump impeller 16 is thus actively driven by the shaft 20. Here, for transmitting the ultrasound oscillations, it is sufficient to set the wall 14 or another housing part into oscillation, and this oscillation is transmitted onto the shaft 20 on account of the propagation of the structure-borne sound.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A submersible pump comprising:

an electrical drive motor (3);

a supply coupled to the electrical drive motor (3) and supplying electricity thereto;

a single-stage or multi-stage centrifugal pump (4) which is driven by the electrical drive motor and having a sensor housing (9) through which fluid flows, the sensor housing being surrounded by and in contact with a surrounding fluid and being arranged between the motor (3) and the pump (4), at an end portion of the pump (4), or within the pump (4), wherein the sensor housing (9) comprises a fluid-leading housing part (12), through which passes delivery flow of the pump (4), and a fluid-free housing part (13), which is separated from the fluid-leading housing part (12) by a housing wall (14);

one or more sensors arranged in the sensor housing (9); and an induction arrangement (17, 18) comprising at least one magnet (17) rotatably arranged in the fluid-leading housing part (12), and at least one induction coil (18) arranged in the fluid-free housing part, wherein the induction arrangement forms part of a flowmeter and the submersible pump is configured such that electrical energy is produced by the induction arrangement upon operation of the pump (4) and provided to the one or more sensors.

2. The submersible pump according to claim 1, wherein the at least one magnet (17) is arranged on a pump impeller (16) which is arranged in the fluid-leading housing part (12), the pump impeller being configured to be rotated by the delivery flow of the pump (4).

3. The submersible pump according to claim 1, wherein the at least one magnet (17) is seated on a pump impeller (16) which is rotatably arranged in the fluid-leading housing part (12) and which is arranged in a rotationally fixed manner on a drive shaft (20) of the pump (4), the drive shaft extending into the fluid-leading housing part (12).

4. The submersible pump according to claim 1, wherein the sensor housing is configured to inductively couple electrical signals of the one or more sensors or data derived from the one or more sensors, with an electrical cable (7) led on an outside of the sensor housing (9).

5. The submersible pump according to claim 4, further comprising structure (20, 21) configured to transmit the electrical signals and/or the data from the sensor housing (9) to a motor housing.

6. The submersible pump according to claim 5, wherein the structure comprises an electro-acoustic transducer acting upon a shaft (20), the electro-acoustic transducer being provided on a sensor housing side; and wherein the structure further comprises an acousto-electrical transducer (21) provided on a motor side; and wherein the submersible pump is configured such that there is mechanical transmission by the shaft (20) of converted electrical signals and/or data from the electro-acoustic transducer to the acousto-electrical transducer.

7. The submersible pump according to claim 1, wherein the sensor housing (9) comprises a temperature sensor, a vibration sensor, and/or a pressure sensor or differential pressure sensor.

8. The submersible pump according to claim 1, wherein the submersible pump is a bore-hole pump.

9. The submersible pump according to claim 1, wherein the housing wall (14) comprises a stainless steel sheet.

* * * * *